US009532647B2

(12) United States Patent
Bedard et al.

(10) Patent No.: US 9,532,647 B2
(45) Date of Patent: Jan. 3, 2017

(54) SYSTEMS AND METHODS FOR IMPROVED MODULAR LABORATORY FURNITURE

(71) Applicant: BEDCOLAB, LTD., Laval (CA)

(72) Inventors: Ron Bedard, Rosemere (CA); Pierre Poirier, Saint-Eustache (CA)

(73) Assignee: Bedcolab, LTD. (CA)

( * ) Notice: Subject to any disclaimer, the term of this patent is extended or adjusted under 35 U.S.C. 154(b) by 0 days.

(21) Appl. No.: 14/498,620

(22) Filed: Sep. 26, 2014

(65) Prior Publication Data

US 2015/0083028 A1 Mar. 26, 2015

Related U.S. Application Data

(60) Provisional application No. 61/883,146, filed on Sep. 26, 2013.

(51) Int. Cl.
*A47B 37/00* (2006.01)
*A47B 83/04* (2006.01)

(52) U.S. Cl.
CPC ..... *A47B 83/04* (2013.01); *A47B 37/00* (2013.01); *A47B 2037/005* (2013.01); *Y10T 29/49826* (2015.01)

(58) Field of Classification Search
CPC ..... A47B 21/06; A47B 2021/064; A47B 2021/066; A47B 2037/005
USPC ..... 108/50.02, 50, 64, 50.01; 312/223.3, 312/223.5, 223.6; 52/36.2, 36.4, 220.1, 220.2
See application file for complete search history.

(56) References Cited

U.S. PATENT DOCUMENTS

| | | | | |
|---|---|---|---|---|
| 3,234,897 | A | 2/1966 | Berk | |
| D220,703 | S | 5/1971 | Deguchi et al. | |
| 4,002,383 | A | 1/1977 | Holloway, Jr. | |
| D244,913 | S | 7/1977 | Brandenfels | |
| 4,050,752 | A | 9/1977 | Dykstra | |
| 4,093,078 | A | 6/1978 | Radek | |
| D257,093 | S | 9/1980 | Brittner | |
| 4,838,177 | A * | 6/1989 | Vander Park | A47B 17/003 108/155 |
| 4,884,702 | A | 12/1989 | Rekow | |
| 4,941,412 | A * | 7/1990 | Engel | A47B 17/00 108/106 |
| 5,004,201 | A | 4/1991 | Bessinger | |
| 5,024,167 | A * | 6/1991 | Hayward | A47B 17/003 108/50.02 |
| D321,447 | S | 11/1991 | Newhouse | |
| 5,083,512 | A * | 1/1992 | Newhouse | A47B 21/06 108/50.02 |
| 5,348,385 | A | 9/1994 | Berg | |
| 5,522,324 | A * | 6/1996 | van Gelder | A47B 21/06 108/50.02 |
| D376,705 | S * | 12/1996 | Stoddard | D6/654.21 |
| 5,606,919 | A * | 3/1997 | Fox | E04B 2/7433 108/50.02 |

(Continued)

OTHER PUBLICATIONS

Edison II Mock-Up Review, Sep. 8, 2005, Cornell University, Ithaca, NY.

(Continued)

*Primary Examiner* — Jose V Chen
(74) *Attorney, Agent, or Firm* — Polster Lieder

(57) ABSTRACT

Systems and methods of assembly and manufacture of a modular laboratory furniture system having a selectively attachable upper framework assembly and easily adaptable configurations with integrated service distribution.

35 Claims, 12 Drawing Sheets

(56) References Cited

U.S. PATENT DOCUMENTS 5,606,920 A * 3/1997 Meyer ..... A47B 17/00 108/50.02
5,638,759 A 6/1997 Klugkist
5,752,449 A * 5/1998 Simon ..... A47B 9/00 108/153.1
5,799,588 A 9/1998 Engel
5,901,513 A 5/1999 Mollenkopf et al.
5,997,397 A 12/1999 Frickel et al.
6,029,832 A 2/2000 Bastian
6,047,838 A 4/2000 Rindoks et al.
6,112,913 A 9/2000 Rindoks et al.
6,115,978 A 9/2000 Bastian et al.
6,138,583 A 10/2000 Mahone et al.
6,202,567 B1 * 3/2001 Funk ..... A47B 21/06 108/50.01
6,267,064 B1 * 7/2001 Ostertag ..... A47B 13/021 108/108
6,283,043 B1 * 9/2001 Stern ..... A47B 13/06 108/50.02
6,397,762 B1 * 6/2002 Goldberg ..... A47B 21/06 108/50.02
6,732,660 B2 * 5/2004 Dame ..... A47B 13/003 108/50.01
D508,343 S 8/2005 Pflaster
D547,097 S 7/2007 Bastian et al.
D587,485 S 3/2009 Albright
7,634,967 B1 * 12/2009 Albright ..... H02G 3/386 108/50.02
8,186,281 B2 * 5/2012 Bastian ..... A47B 21/06 108/50.02
8,196,526 B2 * 6/2012 Rheault ..... A47B 13/10 108/50.01
2002/0043183 A1 * 4/2002 Insalaco ..... A47B 21/06 108/50.02
2002/0069794 A1 * 6/2002 Dame ..... A47B 13/003 108/50.01
2003/0136313 A1 * 7/2003 Griepentrog ..... A47B 83/001 108/50.02
2005/0279033 A1 * 12/2005 Faber ..... E04B 2/7453 52/36.4
2007/0044690 A1 * 3/2007 Lee ..... A47B 81/06 108/50.02
2007/0204537 A1 9/2007 Bastian et al.
2008/0121149 A1 5/2008 Michaud et al.
2014/0312754 A1 * 10/2014 Hecht ..... A47B 9/04 312/309
2014/0331901 A1 * 11/2014 Seefeldt ..... A47B 21/06 108/50.02

OTHER PUBLICATIONS

Max/Wall Technical Wall System, Fisher Hamilton, Form No. AL-1356-1, May 2002.
Distinction Laboratory Bench System, Fisher Hamilton, Form No. AL-1463, Jan. 2006.
Symphonie Table Specification, Cornell University, Nov. 24, 2005.
Edison II Specification, Stanford University, Oct. 1, 2008.
Edison III Specification, Weill Cornell Medical College, Dec. 2, 2010, Laboratory Casework pp. 12360-38-12360-43.

* cited by examiner

FIG. 1
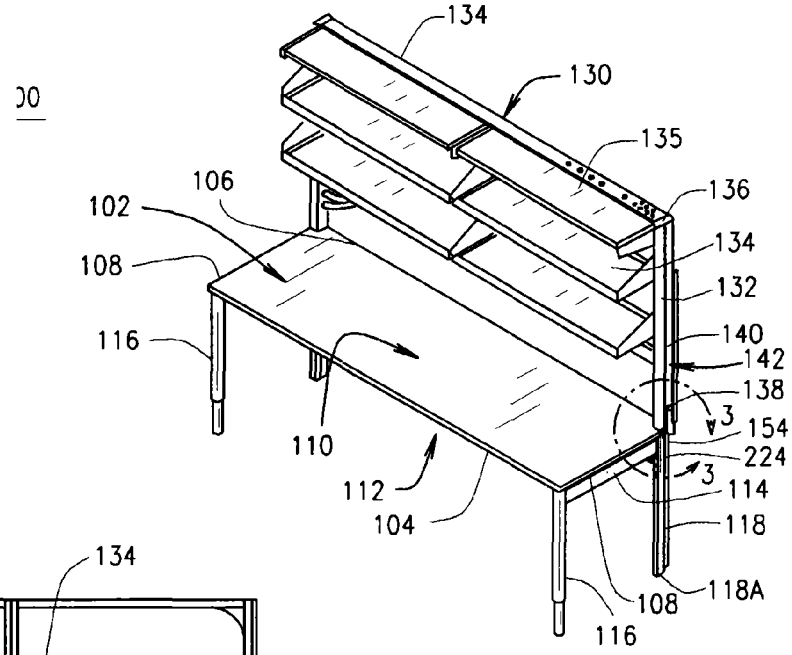
FIG. 1A
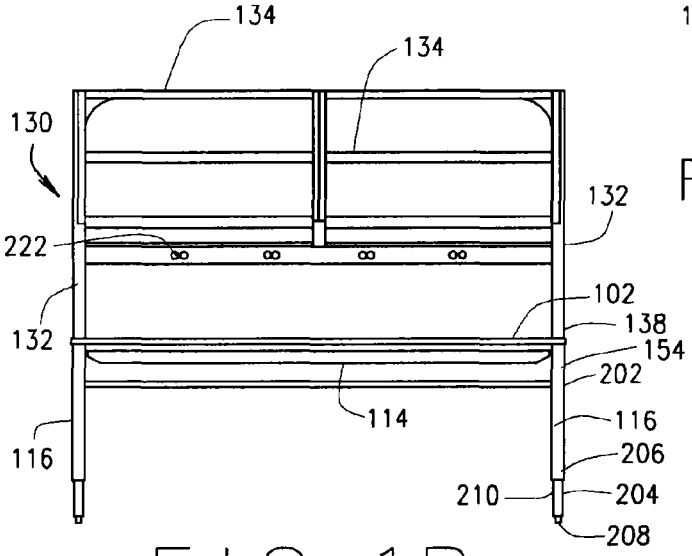
FIG. 1B
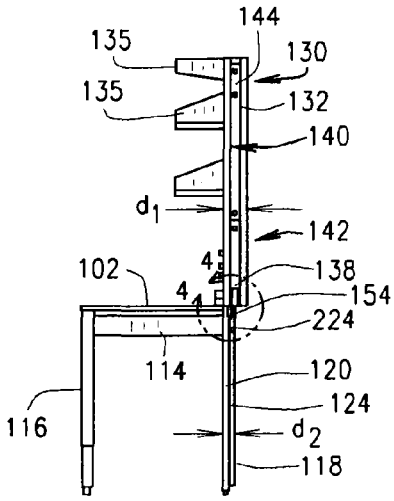
FIG. 1C
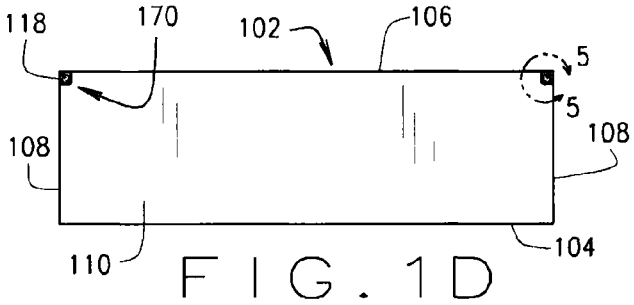
FIG. 1D

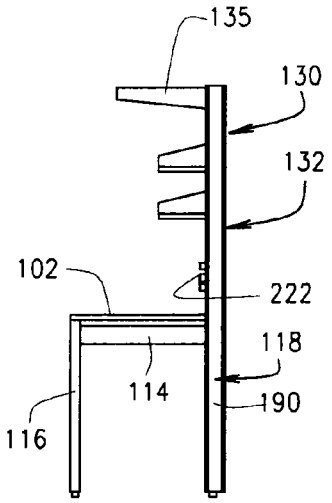
FIG. 6A
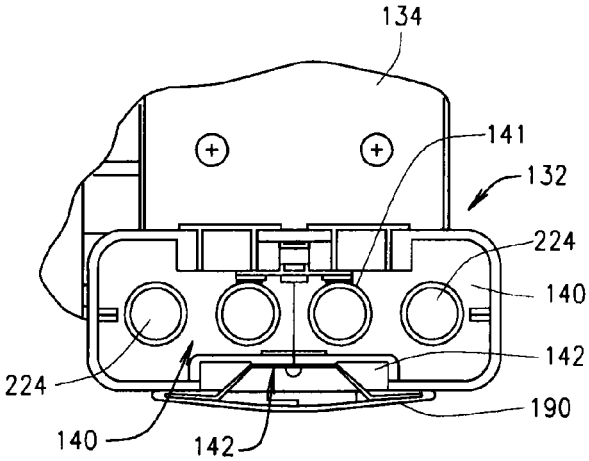
FIG. 7
FIG. 6
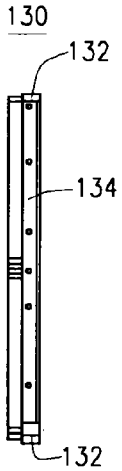
FIG. 6B
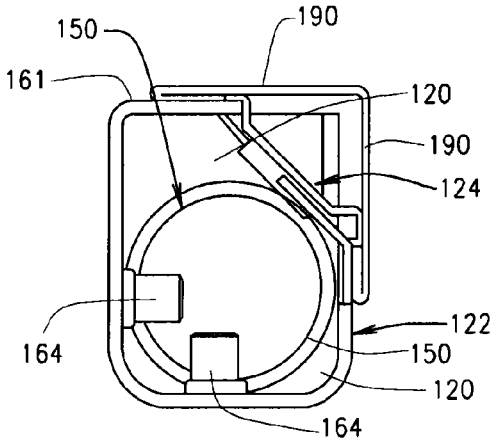
FIG. 8

FIG. 9
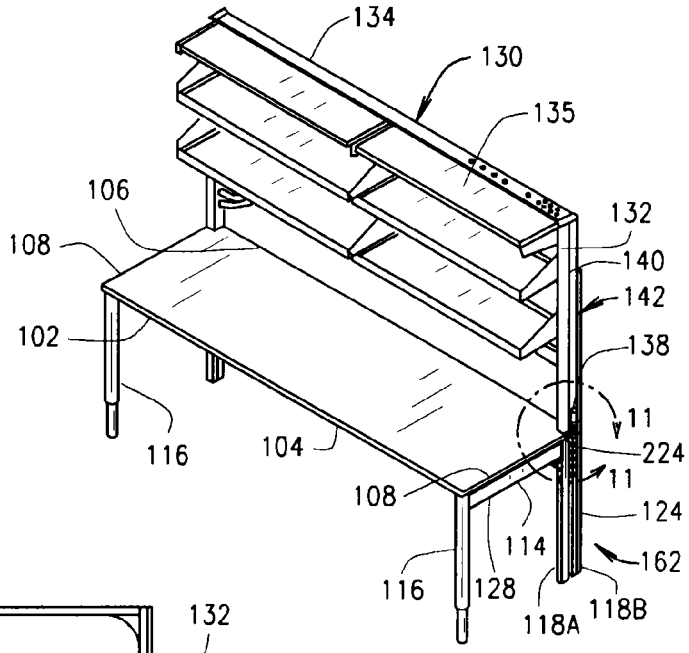
FIG. 9A
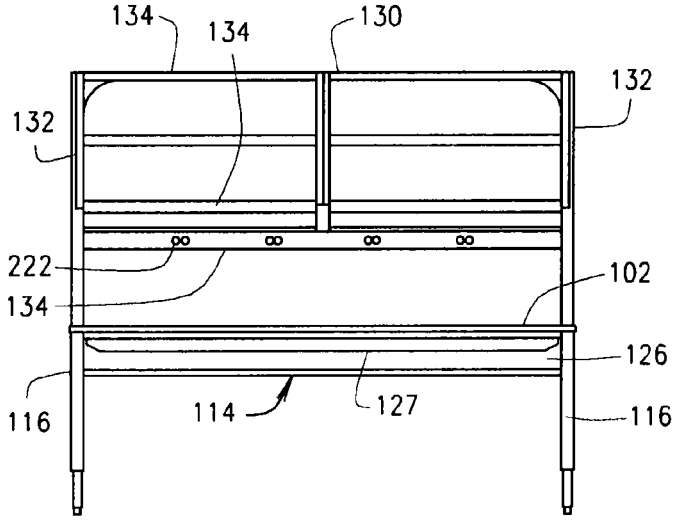
FIG. 9B
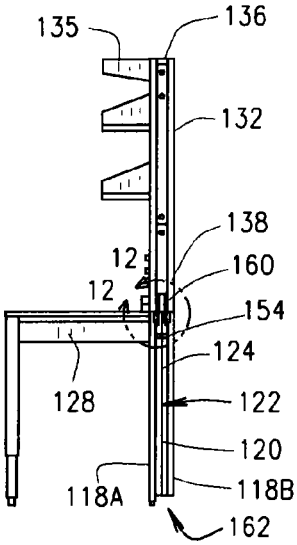
FIG. 9C
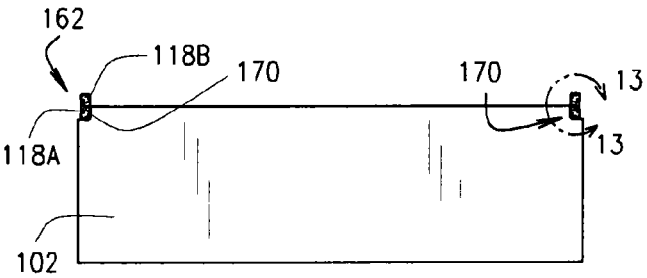
FIG. 9D FIG. 14
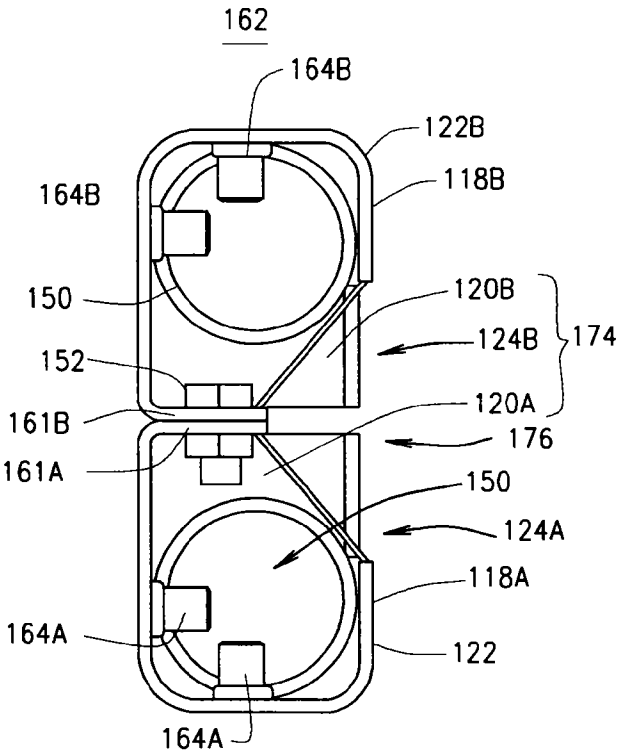
FIG. 14B
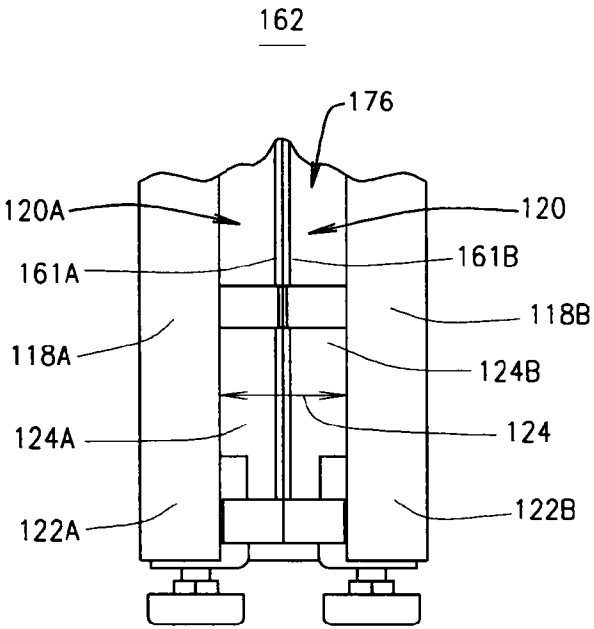
FIG. 14A FIG. 20
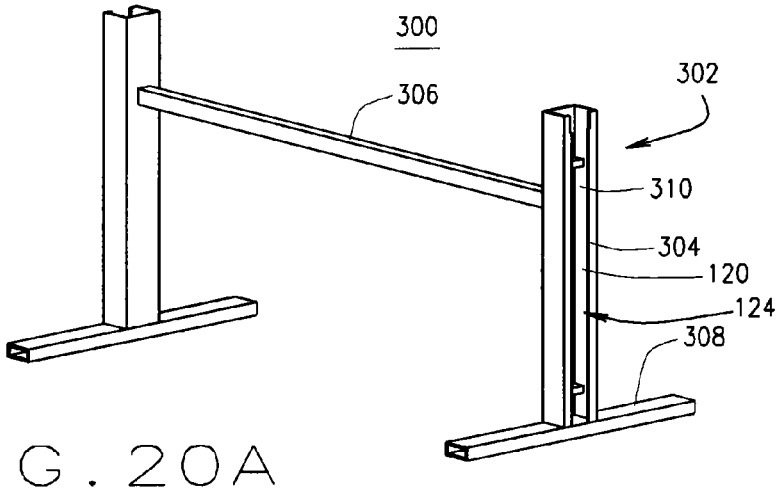
FIG. 20A
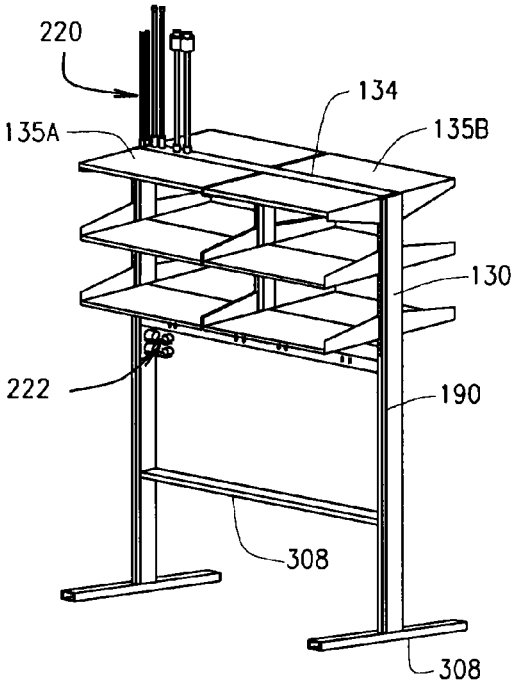
FIG. 20B
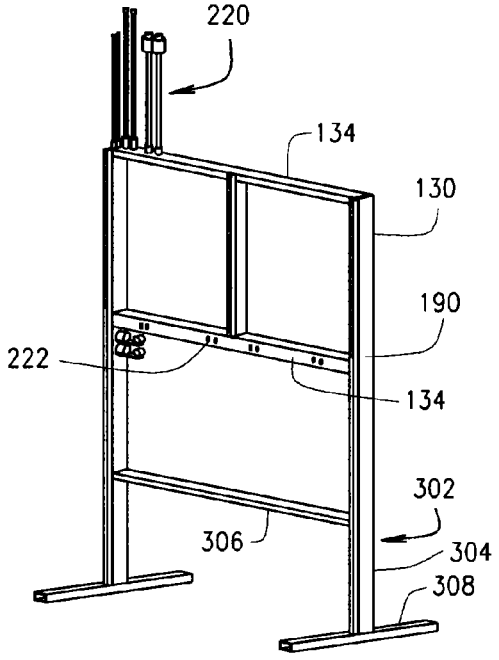
FIG. 20C

SYSTEMS AND METHODS FOR IMPROVED MODULAR LABORATORY FURNITURE

CROSS-REFERENCE TO RELATED APPLICATIONS

This application claims the benefit of U.S. Provisional Application No. 61/883,146, filed on Sep. 26, 2013, the disclosure which is incorporated herein by reference.

FIELD

The present disclosure relates to furniture and, more specifically, to a modular laboratory furniture and assembly and manufacture thereof.

BACKGROUND

The statements in this section merely provide background information related to the present disclosure and may not constitute prior art.

In these days of rapidly evolving technology and developing science, laboratories are challenged to increasingly adapt and change their laboratories space to the changing needs of the various projects from time to time. This requires an increasing adaptable and flexible furniture solution that is unique to laboratories. These require the integration and distribution of services such as electrical, gas, and other fluids to each work station that may also change or need to be easily changed. Existing modular furniture systems are often costly to reconfigure or change to meet the ever changing requirements of the modern laboratory.

SUMMARY

The inventors hereof have succeeded at designing a new and improved modular furniture assembly, system and method that provides laboratories with increased flexibility and lower cost of modification and changes over the life of the modern laboratory. These include features that all for improved flexibility in floor space utilization as well as installation and removal of work station services. These and other benefits will be apparent to one of skill in the art upon reading the following specification and in view of the numerous exemplary embodiments described herein and in the drawing figures.

According to one aspect, In one embodiment, system for modular laboratory furniture having a work surface having a front edge, a back edge, two opposing side edges, a top surface and a bottom surface with a subassembly positioned below the work surface and on which the work surface is mounted and supported, the subassembly having a back surface support and two opposing side surface supports and a pair of front legs. The system further includes a pair of back leg members each selectively couplable to the subassembly proximate to opposing back corners of the subassembly proximate to the intersection of one of the side work surface supports and an end of the back work surface support, each back leg member having an elongated cavity along a length of the back leg member extending downward from a top end thereof and a portion of an outer side that is positioned facing outward from the side edge of the work surface and defining an elongated vertical opening into the elongated cavity of each back leg member. The system also includes a selectively attachable upper framework positionable above the back edge of the work surface, the upper framework having two opposing vertical support members supporting at least one horizontal member that extends between the two vertical support members, each vertical support member having a top end, a lower end, a vertical elongated cavity along its length, a cross-section that is about twice the size of a cross section of one of the back leg members, and an outward facing vertical elongated opening to the cavity, the cavity configured for receiving one or more utility distribution fixtures. The system further includes a mounting mechanism for mounting the lower end of the vertical support members of the upper framework to a top portion of the back leg members.

According to another aspect, wherein the work surface, subassembly, and the pair of front legs are each a first work surface, a first subassembly and a first pair of front legs, respectively. The system further includes a second work surface, a second subassembly, and a second pair of front legs, the second work surface being oriented 180 degrees from the first work surface with the back edges of each work surface being positioned adjacent to each other. The back leg members are dimensioned and configured for attachment to the back portions of each of the first and second subassemblies for commonly supporting both the first and second work surfaces, and for mounting the vertical support members.

According to another aspect, a system for modular laboratory furniture includes a leg support assembly having a pair of opposing leg members with an elongated cavity along a length extending downward from a top end thereof and a portion of an outer side that is positioned facing outward and defining an elongated vertical opening into the elongated cavity of each leg member, the leg support assembly having a lateral member positioned between the two opposing leg members and having a surface mounting member positioned at a bottom end. The system also includes a selectively attachable upper framework positionable above the lateral member and having two opposing vertical support members supporting at least one horizontal member that extends between the two vertical support members, each vertical support member having a top end, a lower end, a vertical elongated cavity along its length, and an outward facing vertical elongated opening to the cavity, the cavity configured for receiving one or more utility distribution fixtures and a mounting mechanism for mounting the lower end of the vertical support members of the upper framework to the top portion of the back leg members.

According to yet another aspect, a method of assembling modular laboratory furniture includes the process of attaching a work surface having a front edge, a back edge, two opposing side edges, a top surface and a bottom surface to a subassembly position below the work surface and on which the work surface is mounted and supported. The method also includes steps of attaching a pair of front legs to the subassembly, and selectively coupling a pair of back leg members to the subassembly proximate to a back corner of the subassembly proximate to the intersection of one of the side lateral supports and an end of the back lateral support, each back leg member having an elongated cavity and a portion of an outer side that is positioned facing outward from the side edge of the work surface defining an elongated vertical opening into the elongated cavity of the leg member. The method further includes selectively attaching an upper framework above the back edge of the work surface, the upper framework having two opposing vertical support members supporting at least one horizontal member that extends between the two vertical support members, each vertical support member having a top end, a lower end that is selectively coupled to a top portion of one of the back leg members, the upper framework also having a vertical elongated cavity along its length and a cross-section that is about twice the size of a cross section of each back leg member, and an outward facing vertical elongated opening to the cavity, the cavity configured for receiving one or more utility distribution fixtures; and securing each vertical support member to one of the back leg members. The attaching the vertical support members of the upper framework can also include inserting an extending member of the lower end of the vertical support member into a top cavity defined in the top portion of the back leg members.

Further aspects of the present disclosure will be in part apparent and in part pointed out below. It should be understood that various aspects of the disclosure may be implemented individually or in combination with one another. It should also be understood that the detailed description and drawings, while indicating certain exemplary embodiments, are intended for purposes of illustration only and should not be construed as limiting the scope of the disclosure.

BRIEF DESCRIPTION OF THE DRAWINGS

FIG. 1 includes FIGS. 1A, 1B, 1C and 1D. FIG. 1A is a top perspective view of a modular laboratory furniture system according to one exemplary embodiment. FIG. 1B is a front view of a modular laboratory furniture system according to the exemplary embodiment of FIG. 1A. FIG. 1C is a side view of a modular laboratory furniture system according to the exemplary embodiment of FIG. 1A. FIG. 1D is a top view of a modular laboratory furniture system according to the exemplary embodiment of FIG. 1A.

FIG. 6 includes FIGS. 6A and 6B that are views of the horizontal member of the upper framework according to the exemplary embodiment of FIG. 1.

FIG. 7 is a top view of the vertical support member of the upper framework along with the attachment of the horizontal member thereto according to the exemplary embodiment of FIG. 1.

FIG. 8 is a bottom view of the back leg member according to the exemplary embodiment of FIG. 1.

FIG. 9 includes FIGS. 9A, 9B, 9C and 9D. FIG. 9A is a top perspective view of a modular laboratory furniture system according to another exemplary embodiment. FIG. 9B is a front view of a modular laboratory furniture system according to the exemplary embodiment of FIG. 9A. FIG. 9C is a side view of a modular laboratory furniture system according to the exemplary embodiment of FIG. 9A. FIG. 9D is a top view of a modular laboratory furniture system according to the exemplary embodiment of FIG. 9A.

FIG. 14 includes FIGS. 14A and 14B. FIG. 14A is a side view of the lower portion of the back to back leg members according to the exemplary embodiment of FIG. 9. FIG. 14B is a bottom view of the lower portion of the back to back legs according to the exemplary embodiment of FIG. 9.

FIG. 20 includes FIGS. 20A, 20B and 20C each of which are various views of a free standing standalone service distribution assembly according to one exemplary embodiment thereof.

It should be understood that throughout the drawings, corresponding reference numerals indicate like or corresponding parts and features.

DETAILED DESCRIPTION

Figure 2:
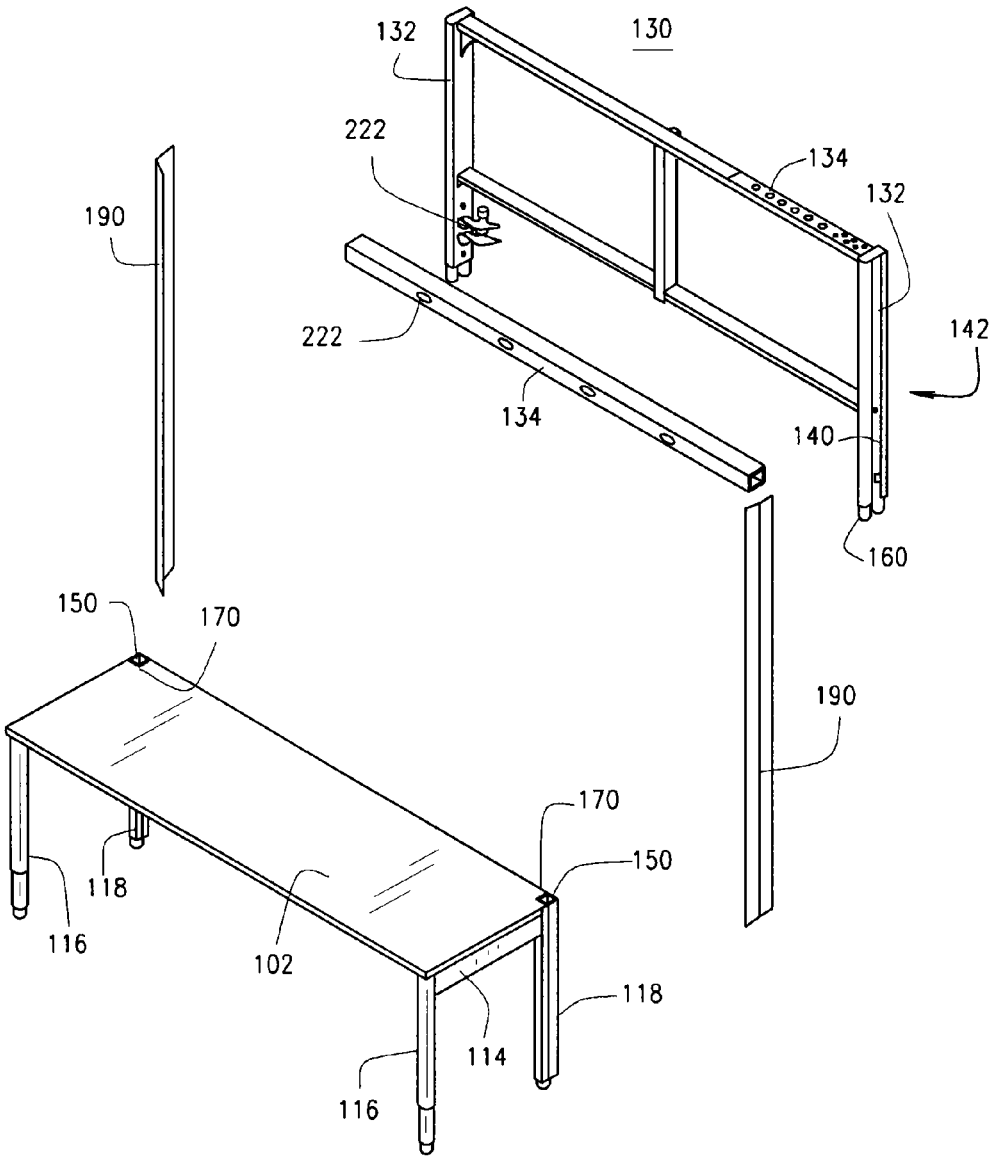
FIG. 2 is a top perspective view of certain unassembled components of the module furniture system according to the exemplary embodiment of FIG. 1.

The following description is merely exemplary in nature and is not intended to limit the present disclosure or the disclosure's applications or uses.

In one embodiment, system for modular laboratory furniture having a work surface having a front edge, a back edge, two opposing side edges, a top surface and a bottom surface with a subassembly positioned below the work surface and on which the work surface is mounted and supported, the subassembly having a back surface support and two opposing side surface supports and a pair of front legs.

The work surface and the subassembly can define a back leg member mounting receptacle for receiving a back leg member. The subassembly can include one or more leg attachment mounting fixtures positioned for selective alignment with one or more of the leg mounting fixtures.

The various fasteners or mounting mechanisms or the like described herein, such as the leg attachment mounting fixtures, by way of example, can be any available and reasonable suitable fastening means and at any suitable location but in some embodiments at least a top section of the front legs are fixedly coupled to the subassembly. These fastening mechanisms can include bolts, screws, hooks and slots, clips, adhesive, by way of example only and not meant to be limited thereto.

The system further includes a pair of back leg members each selectively couplable or mountable to the subassembly proximate to opposing back corners of the subassembly proximate to the intersection of one of the side work surface supports and an end of the back work surface support. Each back leg member has an elongated cavity along a length of the back leg member extending downward from a top end thereof and a portion of an outer side that is positioned facing outward from the side edge of the work surface and defining an elongated vertical opening into the elongated cavity of each back leg member.

The system also includes a selectively attachable upper framework positionable above the back edge of the work surface, the upper framework having two opposing vertical support members supporting at least one horizontal member that extends between the two vertical support members, each vertical support member having a top end, a lower end, a vertical elongated cavity along its length, a cross-section that is about twice the size of a cross section of one of the back leg members, and an outward facing vertical elongated opening to the cavity, the cavity configured for receiving one or more utility distribution fixtures.

The system further includes a mounting mechanism for mounting the lower end of the vertical support members of the upper framework to a top portion of the back leg members. In some embodiments, the mounting mechanism of each back leg member can include a top cavity and the lower end of each vertical support member can include a mating extended portion for inserting into the top cavity of the back leg member on which the vertical support member is mounted.

In some embodiments, each of the back leg members is a first back leg member and the system further includes a second back leg member selectively secured to the first leg portion forming a back leg assembly. The second back leg member has an elongated cavity and a portion of an outer side that is positioned facing outward from the side edge of the work surface. The elongated cavity of the second back leg member combines with the elongated cavity of the first leg member to define a widened elongated back leg cavity and also forms an elongated vertical opening defined by their combination of the side by side leg member openings. The vertical support member of the upper framework is mounted on the back leg assembly and is attached thereto for supporting and securement of the upper framework above the back edge of the work surface.

In some embodiments, each upper portion of at least one of the first or second back leg members of the back leg assembly on either side of the work surface includes a top cavity. In some cases, each of the two vertical support members of the upper frame includes at least one extending mounting member configured to be received into the top cavity of the back leg. At least of the upper vertical support member and one of the first or second back leg members of the back leg assembly includes a securing fixture for mounting the extending mounting member of the vertical support member thereto.

In some embodiments, a cavity cover is dimensioned and configured for selectively covering the elongated combined vertical openings of both the vertical support member of the upper framework and the elongated vertical openings of the back leg members, whether in the single back leg member embodiment or the back to back combination forming the back leg assembly as described herein. Of course it should be understood that in the alternative, one cover can be configured separately for the elongated vertical opening of the vertical support member with a separately attachable leg member opening cover for covering the leg member opening.

In some embodiments, the work surface is a first work surface, and each second back leg member is a back leg member supporting a second work surface oriented 180 degrees back to back with the first work surface with a back edge of the second work surface being adjacent to the back edge of the first work surface.

In some embodiments, the back leg members of each of the first and second work surfaces are selectively coupled together to form a unified back to back work surface with the upper framework positioned above the back edge of the first work surface and the back edge of the second work surface.

In some embodiments, each of the pair of back leg members on each opposing side of the work surface is a first back leg member. The system can also include a pair of second back leg members each of which is coupled or is couplable to a back portion of one of the first back leg members for forming a back leg assembly. The back leg assembly in the single work surface embodiment will have the second back leg member extending backward and outward from the back edge of the work surface. The upper portion of each of the first and second back leg members can include a mounting mechanism for mounting the lower end of one of the vertical support members.

In some embodiments, the front legs can include an upper section and a lower section selectively coupled to the upper section. The upper section can have a proximate end coupled to the subassembly and the lower end coupling to the lower section. The lower section can have a distal end engaging a floor surface on which the furniture system is placed. In some embodiments, at least one of the upper section and lower section includes a height adjustment fixture for selectively defining a plurality of front leg heights by the selective combination of the upper section and the lower section. Further, since the front leg height can be adjustable by the user, each back leg member can include two or more one leg mounting fixtures proximate to the top end thereof for mounting to the subassembly for selectively mounting at two or more heights the lower leg members thereto. For instance, in some embodiments, at least one fastener coupling the leg to the subassembly using at least one leg mounting fixture and at least one back leg member attachment mounting fixture. The back leg member can include a plurality of leg mounting fixtures positioned spaced apart at various distances along the elongated length of the upper portion of the leg and wherein the leg attachment mounting fixture and leg mounting fixture are configured for selective attachment for fixing the leg to the subassembly at one of a plurality of different positions for varying the height of the back leg member from the work surface to the mounting surface.

In some embodiments, the work surface, subassembly, the pair of front legs and the two back leg members are each a first work surface, a first subassembly and a first pair of front legs, and a first two back leg members, respectively. The system also includes a second work surface, a second subassembly, a second pair of front legs and a second pair of two back legs, the second work surface being oriented 180 degrees from the first work surface with the back edges of each work surface being positioned adjacent to each other, wherein each of the back leg members has at least a portion of a leg-to-leg attachment fixture and wherein each back leg is configured for parallel alignment and coupling of the back leg member of the first work surface to the back leg member of the second work surface for securement thereto. In some embodiments, each pair of coupled back leg members includes an upper portion having a mounting mechanism for mounting a portion of a lower end of one of the vertical support members of the upper frame.

In some embodiments, each upper portion of each coupled leg members includes a top cavity. Each of the two vertical support members of the upper frame includes at least one extending mounting member configured to be received into the top cavity of the back leg member and wherein at least one of the upper vertical support member and one of the first or second back leg members includes a securing fixture for mounting and securing the vertical member of the upper framework to the back leg member. In some embodiments, each back leg member includes a portion of an outer side that is positioned facing away from the side edge of the work surface, and wherein each of the first back leg member and the second back leg member defines an elongated vertical opening into an elongated cavity positioned proximate to each other forming a combined elongated vertical opening there between and combined elongated cavity through the coupling of the two back leg members together.

In some embodiments, a cover is dimensioned and configured for selectively covering the combined elongated vertical opening of the combined first and second back leg members forming the back leg assembly and the elongated opening of the vertical support member mounted thereto.

In some embodiments, the work surface, subassembly, and the pair of front legs are each a first work surface, a first subassembly and a first pair of front legs, respectively. The system further includes a second work surface, a second subassembly, and a second pair of front legs, the second work surface being oriented 180 degrees from the first work surface with the back edges of each work surface being positioned adjacent to each other. The back leg members can be dimensioned for attachment to the back portions of each of the first and second subassemblies for commonly supporting both the first and second work surfaces and for mounting the vertical support members.

In another embodiment, a system for modular laboratory furniture includes a leg support assembly having a pair of opposing leg members with an elongated cavity along a length extending downward from a top end thereof and a portion of an outer side that is positioned facing outward and defining an elongated vertical opening into the elongated cavity of each leg member, the leg support assembly having a lateral member positioned between the two opposing leg members and having a surface mounting member positioned at a bottom end. The system also includes a selectively attachable upper framework positionable above the lateral member and having two opposing vertical support members supporting at least one horizontal member that extends between the two vertical support members, each vertical support member having a top end, a lower end, a vertical elongated cavity along its length, and an outward facing vertical elongated opening to the cavity, the cavity configured for receiving one or more utility distribution fixtures and a mounting mechanism for mounting the lower end of the vertical support members of the upper framework to the top portion of the back leg members.

In another embodiment, a method of assembling modular laboratory furniture includes the process of attaching a work surface having a front edge, a back edge, two opposing side edges, a top surface and a bottom surface to a subassembly position below the work surface and on which the work surface is mounted and supported. The method also includes steps of attaching a pair of front legs to the subassembly, and selectively coupling a pair of back leg members to the subassembly proximate to a back corner of the subassembly proximate to the intersection of one of the side lateral supports and an end of the back lateral support, each back leg member having an elongated cavity and a portion of an outer side that is positioned facing outward from the side edge of the work surface defining an elongated vertical opening into the elongated cavity of the leg member.

The method further includes selectively attaching an upper framework above the back edge of the work surface, the upper framework having two opposing vertical support members supporting at least one horizontal member that extends between the two vertical support members, each vertical support member having a top end, a lower end that is selectively coupled to a top portion of one of the back leg members, the upper framework also having a vertical elongated cavity along its length and a cross-section that is about twice the size of a cross section of each back leg member, and an outward facing vertical elongated opening to the cavity, the cavity configured for receiving one or more utility distribution fixtures; and securing each vertical support member to one of the back leg members. The attaching the vertical support members of the upper framework can also include inserting an extending member of the lower end of the vertical support member into a top cavity defined in the top portion of the back leg members.

In some embodiments, the process of selectively attaching the upper framework can include selectively coupling a lower end of each vertical support member to each of the attached first and second back leg members so that the upper framework is selectively mounted to the attached first and second back leg members. In some embodiments, the process of selectively attaching the upper framework can include inserting a pair of extending members of the lower end of each vertical support member into a pair of top cavities defined in the top portions of each of the first and second back leg members. The method can also include selectively placing a single elongated cover over the vertical elongated opening of the vertical support member and the elongated opening of the back leg member on which the vertical support member is mounted.

In some embodiments, the method includes securing the extending member that is inserted into the top cavity of the top portion of the back leg members for fixedly attaching the upper framework to the back leg members.

In some embodiments wherein the pair of back leg members is a first pair of back leg members, the method can include selectively attaching each of a pair of second back leg members to the first back leg members on a backward facing side thereof with the attached second back leg member extending backward and beyond the back edge of the work surface. The selectively attaching the upper framework can include selectively coupling a lower end of each vertical support member to each of the attached first and second back leg members so that the upper framework is selectively mounted to the attached first and second back leg members. In such embodiments, the method of attaching the vertical support members of the upper framework can include inserting a pair of extending members of the lower end of each vertical support member into a pair of top cavities defined in the top portions of each of the first and second back leg members. The method can also include securing the extending members inserted within the top cavities of the top portions of the back leg members for fixedly attaching the upper framework to the coupled pair of back leg members forming a back leg assembly.

In some embodiments, the method can include selectively placing a single elongated cover over the vertical elongated cavity of the vertical support member and the combined side by side openings of each of the coupled back leg members on which the vertical support member is mounted.

In some embodiments where the work surface, the subassembly, and the pair of front legs are each a first work surface, a first subassembly, a first pair of front legs, the method can include attaching a second work surface to a second subassembly position below the second work surface and on which the second work surface is mounted and supported. This method can include attaching a pair of second front legs to the second subassembly and positioning the coupled second work surface attached to the second subassembly in a back to back position relative to the first work surface so that each back edge is adjacent and abutted against each other and forming a combined work surface. This method can also include selectively attaching the second back legs that are selectively attached to the first back legs to a second subassembly to the second subassembly.

The method can include the process of securing the inserted extending members inserted into the top cavities of the top portions of the back leg members for fixedly attaching the upper vertical members to the coupled pair of back legs on each side of the back side of the combined work surface.

In some embodiments, the method can include selectively placing a single elongated cover over the vertical elongated cavity of the vertical support member and the combined opening formed by the side by side positioning of the elongated openings of the combined and coupled first and second back leg members on which the vertical support member is mounted.

Figure 4:
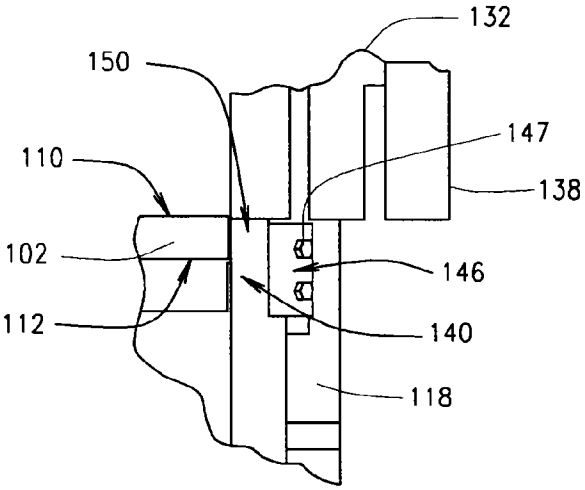
FIG. 4 is side view of FIG. 3 according to the exemplary embodiment of FIG. 1.
Figure 5:
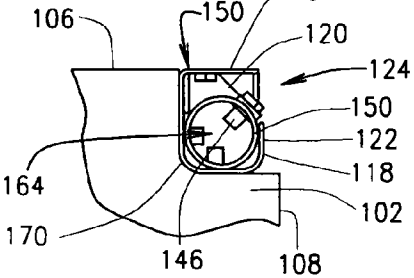
FIG. 5 is a bottom view of the single back leg mounted or attached to the work surface and supporting subassembly without the attached vertical support member being mounted thereto according to the exemplary embodiment of FIG. 1.
Figure 3:
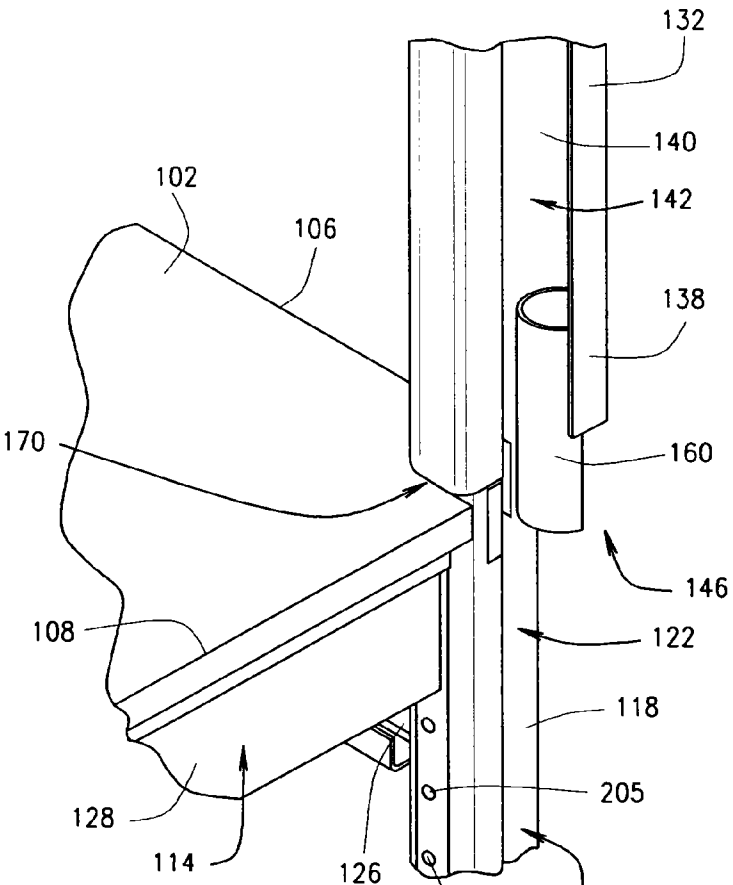
FIG. 3 is a side cut out perspective view of the coupling of the vertical support member of the upper framework to a back leg member according to the exemplary embodiment of FIG. 1.

Referring now to the drawings for a description of several exemplary embodiments. FIGS. 1-8 reflect various configurations, features and options referred herein as a first exemplary embodiment. FIG. 1 includes FIG. 1A, a top perspective view of a modular laboratory furniture system 100, FIG. 1B a front view, FIG. 1C a side view, and FIG. 1D a top view. FIG. 2 illustrated a perspective view of a portion of the unassembled components of the module furniture system 100 of FIG. 1. FIG. 3 is a side perspective view of cutout section 3-3 as shown in FIG. 1A, FIG. 4 is the side cut out view of section 4-4 shown in FIG. 1C and FIG. 5 is the top view of cut out section 5-5 as shown in FIG. 1D. FIG. 6A illustrates an optional side view showing elongated cover in place and FIG. 6B shows a top view of the detached upper framework. FIG. 7 shows a cut out top view of the vertical support member and the horizontal member of the upper framework of FIG. 6A and FIG. 8 is a bottom view of the back leg member. These Figures will not be described with reference to each and their common and different elements.

As shown, furniture system 100 includes a work surface 102 that has a top surface 110 and a bottom 112, with a front edge 104, a back edge 106 and two opposing side edges 108. This is shown as a rectangle work surface 102, but other shapes of the work surface 102 are also possible. The work surface 102 is mounted and supported by a subassembly 114 that typically has a back surface support 126, two opposing side surface supports 128 and can also include a front surface support 127. The subassembly 114 is supported by front legs 116 and back leg members 118. As will be discussed, the present disclosure addresses the improvements that are related to the back leg members 118 and the flexibility of the back leg members 118 as well as improvements to these other work surface elements. The back leg members 118 are positioned at the opposing back corners of the work surface 102 such as in a mounting receptacle 170 formed in the work surface 102 and similarly formed in the subassembly 114. Each back leg member 118 has a top cavity 150 positioned at the top end 154 of the back leg member. Each back leg member 118 has a back surface portion 161 that is substantially flat and also has one or more back leg mounting mechanisms 164 for mounting the back leg members 118 to the subassembly 114 when the back leg member 118 is positioned in the mounting receptacle of the work surface 102. The leg mounting mechanisms 164 can include a plurality of spaced apart features to enable the attachment of the back leg members 118 to the subassembly 114 at various positions for varying the height of the work surface 102. The subassembly 114 can include a securing fixture 146 having one or more subassembly mounts 147 for the back leg members 118 for engagement or coupling or otherwise engagement with the back leg mounting mechanisms 164. These securing fixtures 146 and subassembly mounts 147 can be on the back surface support 126 and/or the side surface support 128 of the subassembly 114.

As the back leg member 118 includes back leg mounting mechanism 164 for selectively defining the height of the back leg member 118 and therefore the height of the work surface 102 from the mounting surface or floor, the front legs 116 can be configured with a height adjustment feature 212 as well. As shown in FIG. 1B, each front leg 116 can include a top section 202 that is mounted or mountable to the subassembly 114 and a bottom or lower leg section 204 having a distal end 208 for placement or engagement with the mounting surface. A lower portion 206 of the top section 202 can selectively engage an upper portion 210 of the lower section 204 and include fixtures and other configuration for selectively defining the working height of the front legs 116 as necessary to level the work surface 102 consistent with the height of the back leg members 118 as well as the mounting surface.

Each back leg member 118 has an elongated cavity 120 positioned along a length of the back leg member 118 typically extending downward from a top end 154 of the back leg member 118 for receiving one or more user service utilities 222 such as electrical wiring, and piping for gas or water or other fluids. For ease of access, each back leg has an outer side 122 that is positioned facing outward from the side edge 108 of the work surface 102 and also has an elongated vertical opening 124 to the elongated cavity 120 of each back leg member 118, again for ease of access, maintenance and for modification and changes thereto. A cover 190 is dimensioned and configured for placement over the opening 124 for selectively covering and sealing the opening 124 and for providing an improved aesthetic to the installed furniture system during operation in a laboratory. The back leg member 118 can be of any shape or any size, but in the embodiment shown in FIG. 1, has a cross sectional area d2 and size such that the back leg member 118 does not extend beyond the back edge 106 of the work surface 102.

The furniture system 100 also includes a utilitarian distribution center in the form of an upper framework 130. The upper framework 130 includes two opposing vertical supports or vertical support members 132 and one or more horizontal members 134. The vertical support members 132 have a top end 136 and a lower end 138 and define an elongated cavity 140 for receiving a maintaining user service utilities as well as in some embodiments one or more utility distribution fixtures 224, such as electrical outlets, by way of example. The horizontal members 134 can also include one or more distribution fixtures 224 and also include cavities coupled to the cavities 140 of the vertical support members 132 for distribution of the user service utilities 222 there between. One or more shelves 135 can be positioned on the horizontal members 134 as well. An elongated opening 142 is defined in the outwardly facing side or surface of the vertical support 132 for ease of installation and maintenance and removal of the user service utilities 222 from the elongated cavity 140. The cover 190 can also be dimensioned and configured for selectively covering the opening 142. The cover 190 can be elongated and dimensioned and configured to selectively cover both opening 142 of the vertical support 132 as well as the opening 124 of the back leg member 118.

A securing fixture 146 is provided for attaching the vertical support 132 to the back leg member 118, typically about the top end 154 of the back leg member 118. In this illustrated embodiment, the upper framework 130 includes an extending member 160 such as a tube 160 that extends downward from the lower end 138 of the vertical support 132. The back leg member 118 has a top cavity 150 configured for receiving the extending member 160. One or more mounting fixtures or subassembly mounts 147 are provided with the securing fixture 146 for selectively securing the mounting of the vertical support 132 to the back leg member 118. The cavity 140 of the vertical support 132 is aligned and continuous with the cavity 120 of the back leg member 118. Further, the opening 142 of the cavity 140 of the vertical support 132 can also be aligned and continuous with the opening 124 to cavity 120 of the back leg member. In this manner, the user service utilities 222 such as electrical wires and fluid pipes can be placed within the combined cavity 120, 140 and access from openings 124, 142 when any cover 190 is not in place.

Figures 15, 15A, 15B, 15C, 15D:
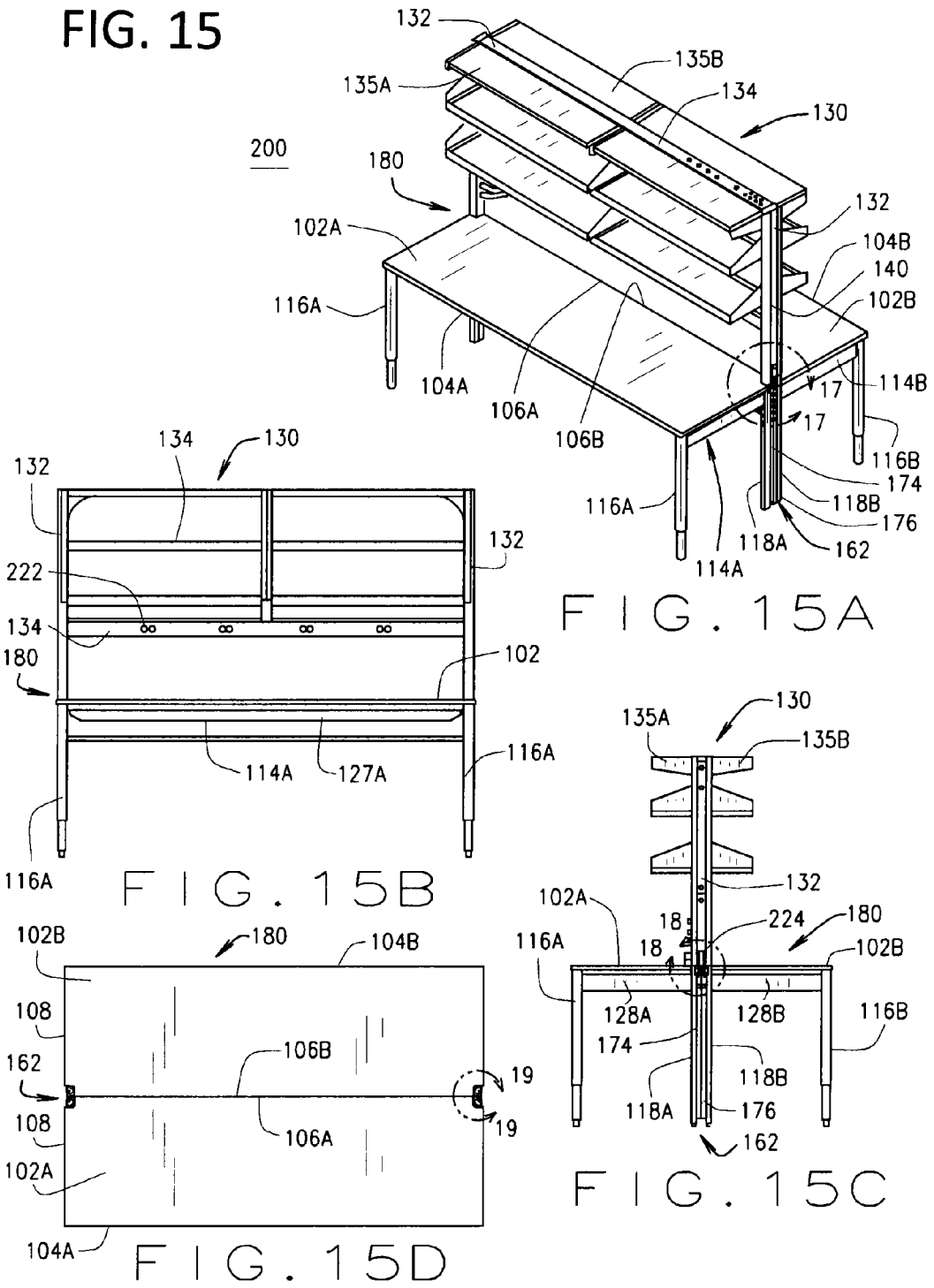
FIG. 15 includes FIGS. 15A, 15B, 15C and 15D.
FIG. 15A is a top perspective view of a modular laboratory furniture system according to another exemplary embodiment.
FIG. 15B is a front view of a modular laboratory furniture system according to the exemplary embodiment of FIG. 15A.
FIG. 15C is a side view of a modular laboratory furniture system according to the exemplary embodiment of FIG. 15A.
FIG. 15D is a top view of a modular laboratory furniture system according to the exemplary embodiment of FIG. 15A.

As shown in this embodiment, the cross sectional area d1 of the vertical support 132 is twice the size from front to back as d2 of the back leg member 118. As such, when the vertical support 132 is mounted to a single back leg member 118 as shown in FIG. 8, the vertical support 132 will extend backward and beyond the back edge 106 of the work surface 102. In this embodiment, the work surface 102 can be dimensioned outwardly to correspond with the back extended end of the back of the vertical support 132, or in some embodiments, a separate spacer can be placed along the back edge 106 of the work surface to fill in the space so that the work surface 102 can be placed flush against a wall when the back side of the upper framework 130 is also placed against the wall. This also applies in embodiments as will be described in FIG. 9 below, as it generally applies in embodiments where there is a single work surface 102, e.g., not a dual or back to back work surface as provided by the exemplary embodiment of FIG. 15 as will be discussed below in further detail.

Figure 10:
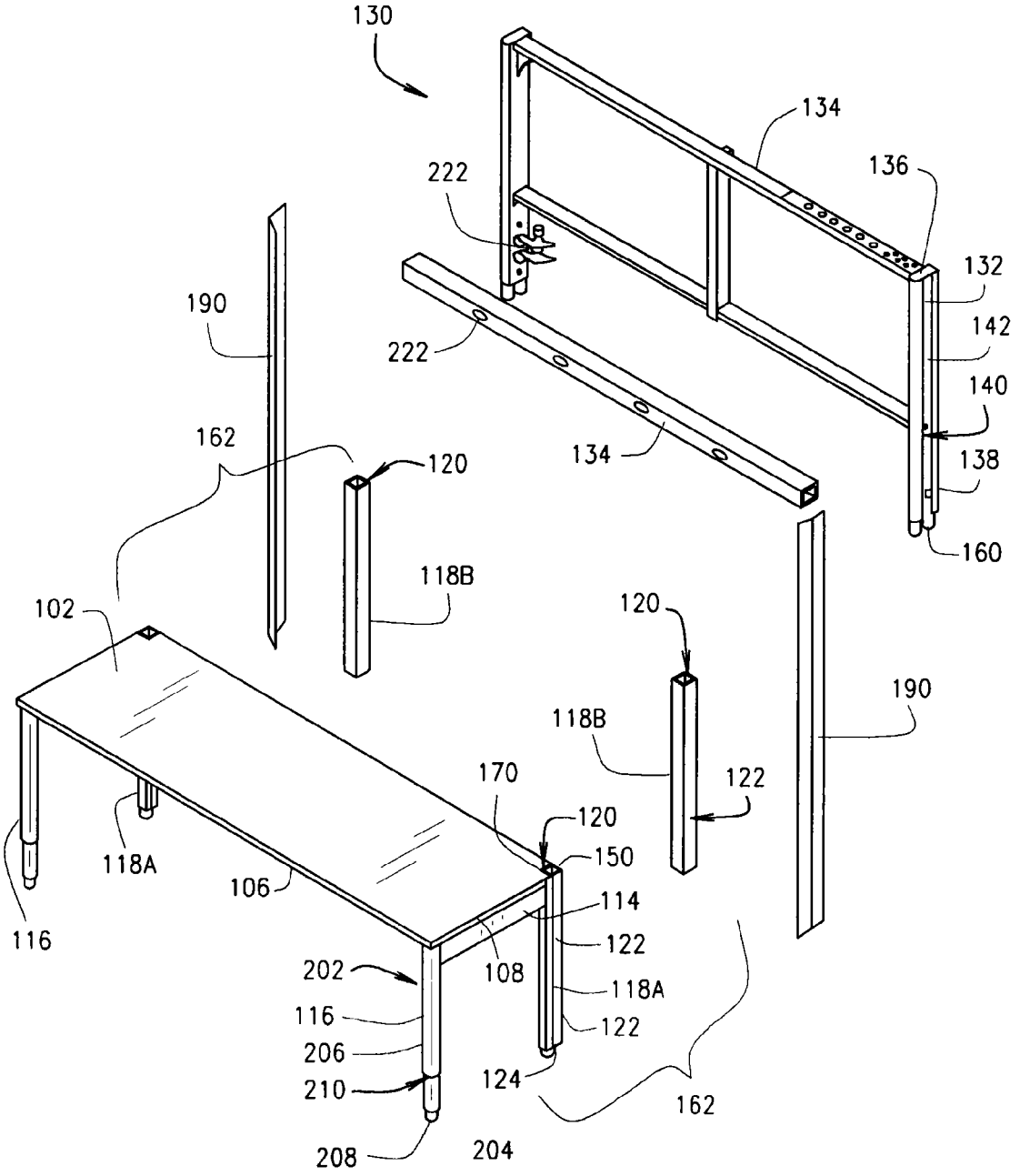
FIG. 10 is a top perspective view of certain unassembled components of the module furniture system according to the exemplary embodiment of FIG. 9.
Figure 12:
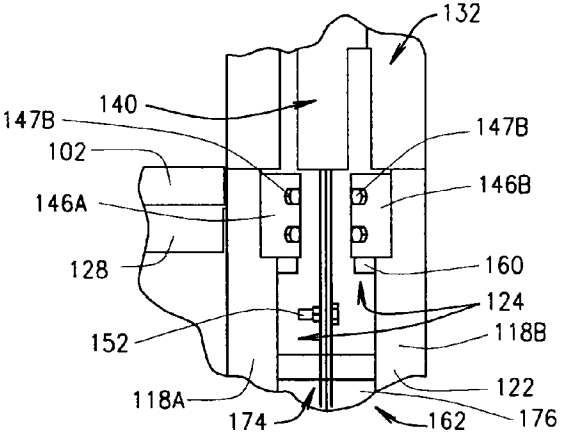
FIG. 12 is a side view of FIG. 11 according to the exemplary embodiment of FIG. 9.
Figure 13:
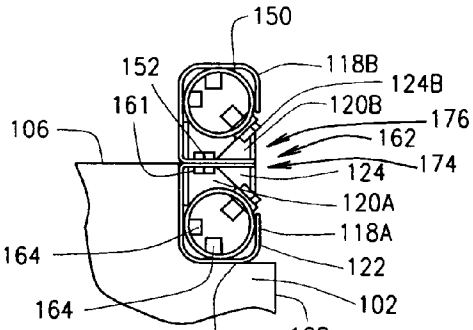
FIG. 13 is a bottom view of the two back-to-back back leg members mounted or attached to the work surface and supporting subassembly without the attached vertical support member being mounted thereto according to the exemplary embodiment of FIG. 9.
Figure 11:
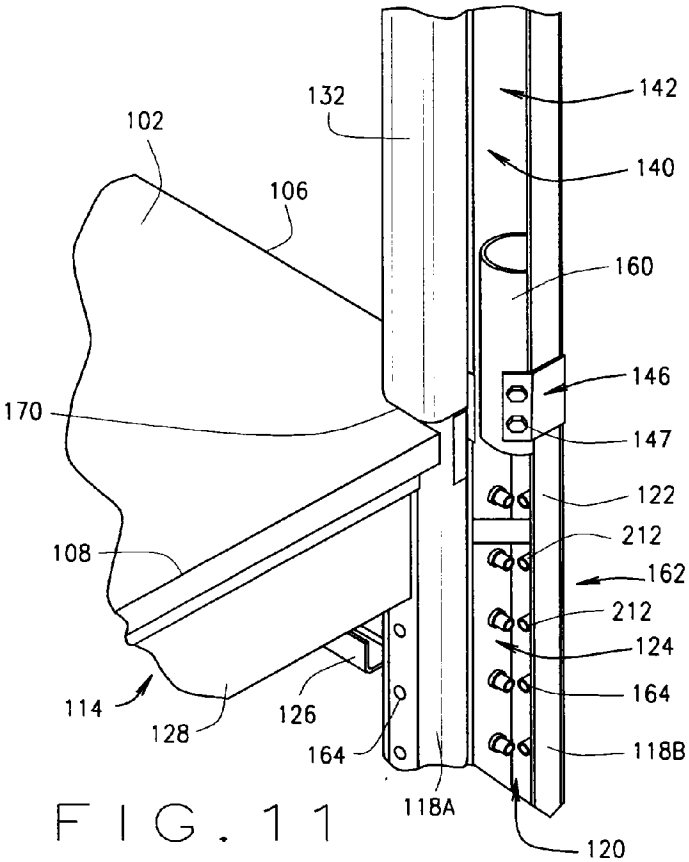
FIG. 11 is a side cut out perspective view of the coupling of the vertical support member of the upper framework to two back leg members according to the exemplary embodiment of FIG. 9.

FIGS. 9-14 are now referred to for different embodiment of the furniture system. FIG. 9A is a top perspective view of a modular laboratory furniture, with FIG. 9B being a front view, FIG. 9C a side view, and FIG. 9D being a top view thereof. FIG. 10 is a top perspective view of certain unassembled components of the module furniture system of FIG. 9. FIG. 11 is a side cut out perspective view of the section 11-11 shown in FIG. 9A, FIG. 12 is a side view of the section 12-12 shown in FIG. 9C and FIG. 13 is a top view of section 13-13 shown in FIG. 9D. FIG. 14A is a side view of the lower portion of the back to back leg members of FIG. 9, and FIG. 14B is a bottom view of the lower portion of the back to back leg member thereof.

The embodiment illustrated in FIGS. 9-14 is similar to that addressed above with regard to FIGS. 1-8 but are different as the back leg member 118 of the prior discussion is supplemented with a back leg assembly 162 formed from the coupling of a first leg member 118A and a second leg member 118B. The back leg members 118A, 118B are dimensions and have a cross sectional area d2 that when combined equal or is substantially the same as the cross sectional area d1 of the vertical support 132. As shown, the first back leg member 118A has back surface 161A and second back leg member 118B has back surface 161B. When placed in a back to back position as shown in FIG. 13, the two leg members 118A, 118B can be secured together by leg to leg attachment fixtures 152 thereby stabilizing them as the back leg assembly 162.

In this manner, when the vertical support 132 is mounted to the back leg assembly 162, the combination provides a continuous cavity 140 into the combined cavity 174 comprised of the back to back placement of the first cavity 120A of first back leg member 118A and the second cavity 120B of the second back leg member 118B. Further the wider opening 142 of the vertical member can now be continuous with the combined width of the first opening 124A of the first back leg member 118A with that of the second opening 124B of the second back leg member 118B.

Further, as there is now two back leg member 118A, 118B on which to mount the vertical support 132, the vertical support 132 can include two extending members 160A and 160B each for placement in a different top cavity 150A and 150B of back legs 118A and 118B, respectively. Two securing fixture assemblies 146A, 146B include one or more securing subassembly mounts 147A securing extending member 160A within cavity 150A and therefore to back leg member 118A, and one or more securing subassembly mounts 147B securing extending member 160B within cavity 150B and therefore to back leg member 118B.

Figure 16:
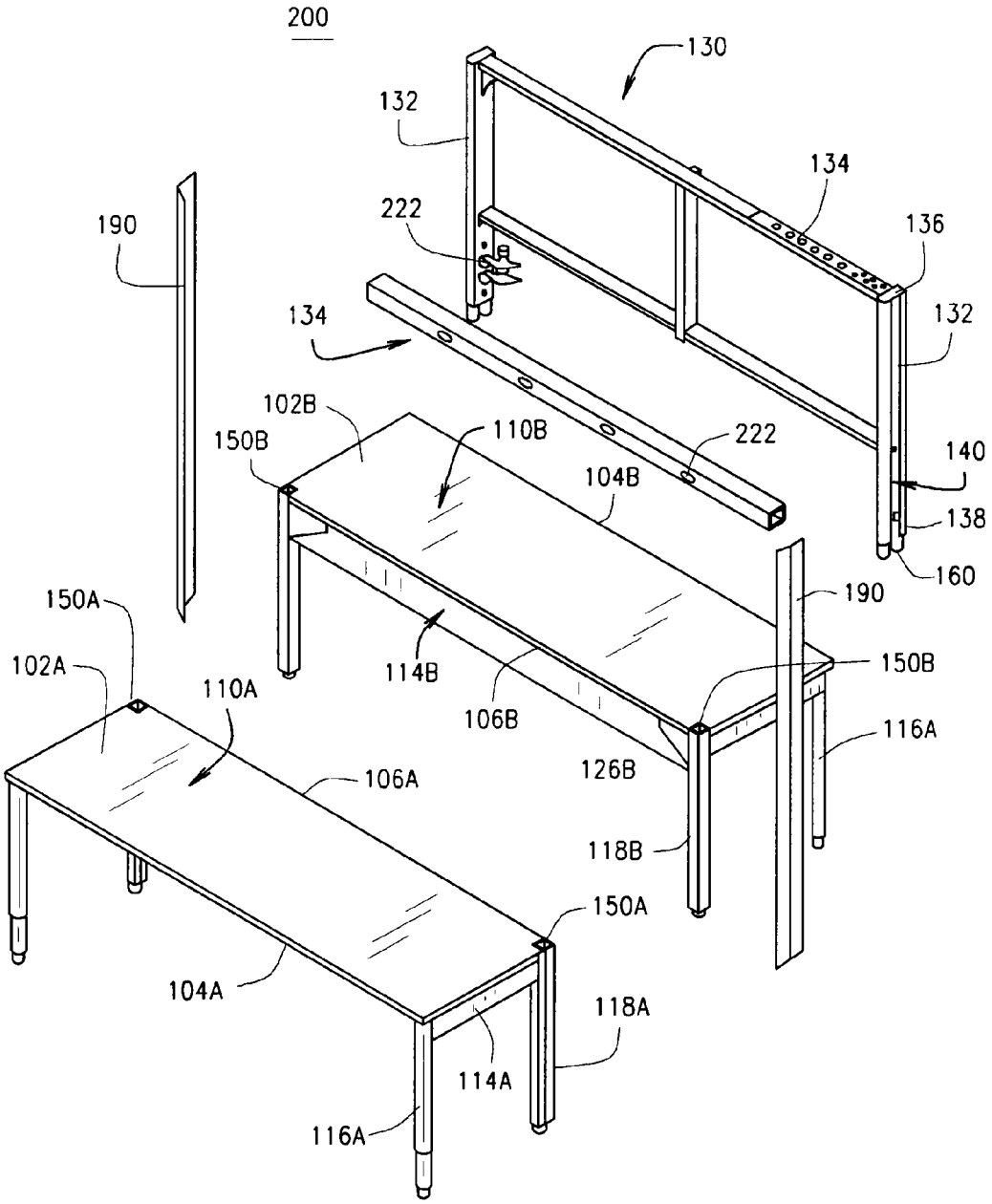
FIG. 16 is a top perspective view of certain unassembled components of the module furniture system according to the exemplary embodiment of FIG. 15.
Figure 18:
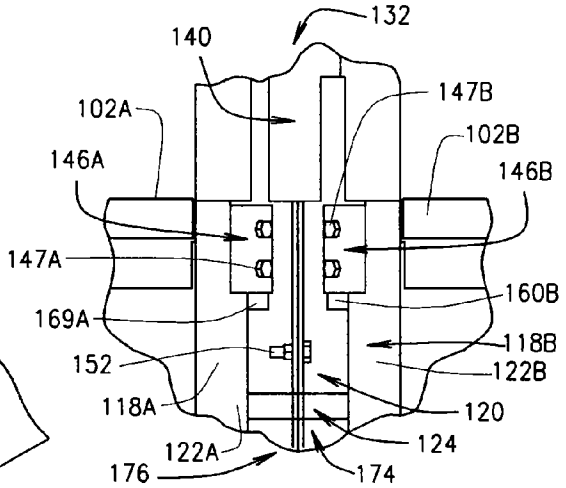
FIG. 18 is a side view of FIG. 17 according to one embodiment of the exemplary embodiment of FIG. 15.
Figure 19:
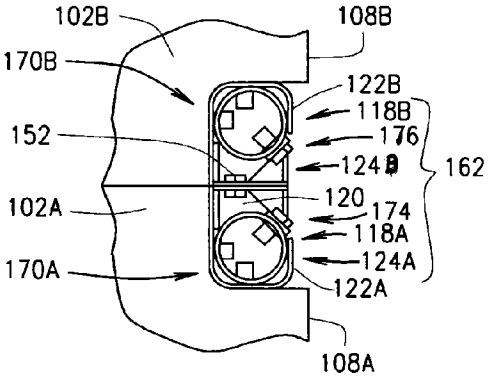
FIG. 19 a bottom view of the two back-to-back back leg members mounted or attached to the work surface and supporting subassembly without the attached vertical support member being mounted thereto according to the exemplary embodiment of FIG. 15.
Figure 17:
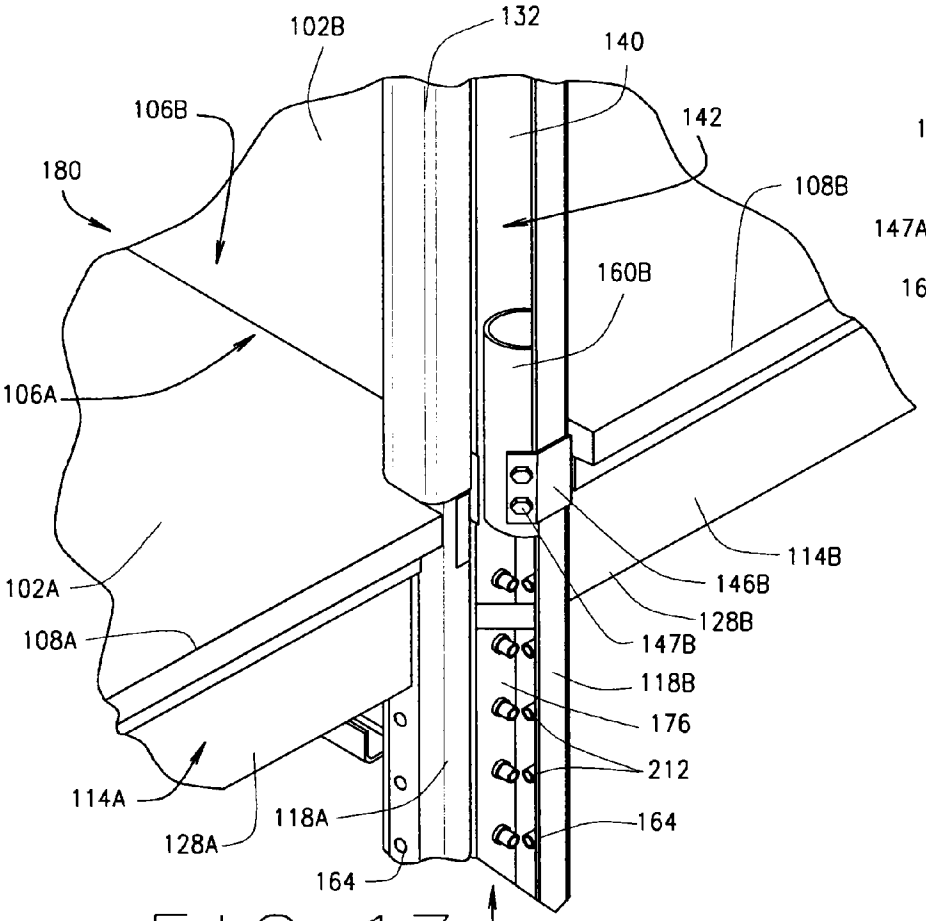
FIG. 17 is a side cut out perspective view of the coupling of the vertical support member of the upper framework to two back leg members according to the exemplary embodiment of FIG. 15.

FIGS. 15-19 are now referred to for yet another different embodiment of the furniture system. FIG. 15A is a top perspective view of a modular laboratory furniture, with FIG. 15B being a front view, FIG. 15C a side view, and FIG. 15D being a top view thereof. FIG. 16 is a top perspective view of certain unassembled components of the module furniture system of FIG. 15. FIG. 17 is a side cut out perspective view of the section 11-11 shown in FIG. 15A, FIG. 18 is a side view of the section 18-18 shown in FIG. 15C and FIG. 19 is a top view of section 19-19 shown in FIG. 15D.

The embodiment illustrated in FIGS. 15-19 represents the flexibility of the presently disclosed furniture system. This embodiment is not a different system, but an assembled variation of the systems as described above with regard to FIGS. 1-14 but having two work surfaces 102A, 102B positioned to form furniture system 200 having a combined work surface 180. When compared to the first embodiment of FIGS. 9-14, this illustrated system 200 has first work surface 102A with first mounting receptacle 170A and first leg member 118A and first side support 128A mounted below first side edge 108A. However, it also has the second back leg member 118B mounted in place. The second work surface 102B has side edge 108B and includes the second receptacle 170B. The second work surface 102B is mounted to a second subassembly 114B that includes the second side supports 128B and is also supported by second front legs 116B. In this manner, the second work surface 102B is positioned 180 degrees relative or in orientation to the first work surface 102A but with the second back edge 106B adjacent to and up against the first back edge 106B thus forming the combined work surface 180. As shown in FIG. 19, the back leg assembly 162 includes the back to back positioned first and second leg members 118A, 118B coupled along back surfaces 161A, 161B by one or more fasteners 152. The combined cavity 174 is formed by the combined side by side positioning of the first cavity 120A with second cavity 120B. Similarly, the combined opening 176 to the combined cavity 174 is formed by the side by side positioning of the first opening 124A with the second opening 124B between or on the outer side 122A of the first leg member 118A and the outer side 122B of the second leg member 118B.

Where the back leg assembly 162 is already installed with the first and second back leg members 118A and 118B coupled together, the upper framework 130 can already have been placed or mounted by mounting the vertical member 132 to the back leg assembly 162 as described above. The user service utilities 222 can remain in place with minimal changes. The upper framework 130 also already had the horizontal members 134 in place above the back edge 106 of the first work surface 102A. Once the second work surface 102B is mounted via second subassembly 114B to the second back leg members 118B, the second shelving 135B can be added if desired for access by a user of the second work surface 102B when positioned along second front edge 104B. This is as opposed to a user positioned along first front edge 104A that accesses first shelving 135A.

Referring now to another embodiment shown in the Figures, FIG. 20 consisting of FIGS. 20A, 20B and 20C that are various views of a free standing standalone service distribution assembly 300.

This embodiment further illustrates the flexibility of the presently disclosed furniture system. The system 300 as shown in FIG. 20, includes the same upper framework 130 with the vertical supports 132 and the horizontal member 134 as previously discussed, but in system 300, the upper framework 130 is mounted to a free standing base 302 rather than being mounted to a back leg member 118 that in part supported a work surface 102. In this embodiment, free standing base 302 has a lower vertical support leg 304 with the cavity 120 and opening 124 as described above for the back leg member 118. However, the cavity 120 is open at the top end of the vertical support leg 304. The distal end of the vertical support leg 304 terminates with a mounting to a surface mount 308, which as illustrated in this embodiment can be an assembly having opposing front and rear surface mount extensions. A horizontal member 306 couples the two opposing vertical support legs 304.

FIGS. 20B and 20C illustrate the upper framework 130 being mounted onto the free standing base 302. In this configuration, the system 300 enables a user to utilize the distribution services of the user service utilities within the cavity 140 of the upper framework 130 but removing the work surface 102 and subassembly 114 with front legs 116 therefrom, but utilize other forms of furniture or equipment such as test equipment or systems having their own housings or cabinetry or with other forms of laboratory furniture systems such as legacy furniture. Also as shown in these figures, but as can apply to all embodiments, the service access 220 to external service supplies such as electrical wiring or service, water or gas or the like, can be provided from a top access to the upper frame work 130 for providing to the cavity 140 thereof. Of course, those of skill in the art will understand that service access 220 can also be provided from underneath the floor, or from a wall and as such, the service access 220 can be provided via the back leg members 118 for feeding upward rather than as shown in FIGS. 20B and 20C and feeding downward.

As described with regard to FIGS. 1-20, the various embodiments and configurations illustrate the flexibility and improvement of laboratory furniture. For example, once an upper framework 130 is installed such as with user services via service access 220, the user can change the working environment for the system from a single sided work station of system 100 and 200, to a dual sided work station of system 300, or remove the work stations altogether and only utilize the free standing system of system 400. Each provides ease of access to the user service utilities within cavities 140 and 120 and each provides for the aesthetic and protective selective covering of the openings 142 and 124 to the cavities.

When describing elements or features and/or embodiments thereof, the articles "a", "an", "the", and "said" are intended to mean that there are one or more of the elements or features. The terms "comprising", "including", and "having" are intended to be inclusive and mean that there may be additional elements or features beyond those specifically described.

Those skilled in the art will recognize that various changes can be made to the exemplary embodiments and implementations described above without departing from the scope of the disclosure. Accordingly, all matter contained in the above description or shown in the accompanying drawings should be interpreted as illustrative and not in a limiting sense.

It is further to be understood that the processes or steps described herein are not to be construed as necessarily requiring their performance in the particular order discussed or illustrated. It is also to be understood that additional or alternative processes or steps may be employed.

What is claimed is:

1. A modular laboratory furniture system having a work surface having a front edge, a back edge, two opposing side edges, a top surface and a bottom surface and a subassembly positioned below the work surface and on which the work surface is mounted and supported, the subassembly having a back surface support and two opposing side surface supports and a pair of front legs, the system further comprising;

a pair of back leg members each selectively couplable to the subassembly proximate to opposing back corners of the subassembly proximate to the intersection of one of the side work surface supports and an end of the back work surface support, each back leg member having at least a back side, an outer side, a first end and an opposing second end and an entire vertical back leg length defined therebetween, and an elongated cavity along a length of the back leg member extending downward from a top end thereof and a portion of the outer side that is positioned facing outward from the side edge of the work surface and having an elongated vertical opening into the elongated cavity of each back leg member along at least a portion of entire vertical back leg length on the back side of the back leg member and at least a portion of the entire vertical back leg length of the outer side of the back leg member;

a selectively attachable upper framework positionable above the back edge of the work surface, the upper framework having two opposing vertical support members supporting at least one horizontal member that extends between the two vertical support members, each vertical support member having a top end, a lower end, a vertical elongated cavity along its length, a cross-section that is about twice the size of a cross section of one of the back leg members, and an outward facing vertical elongated opening to the cavity, the cavity configured for receiving one or more utility distribution fixtures; and a mounting mechanism for mounting the lower end of the vertical support members of the upper framework to a top portion of the back leg members.

2. The furniture system of claim 1 wherein each of the back leg members is a first back leg member having a first elongated cavity and a first elongated vertical opening into the first elongated cavity along the entire vertical back leg length of a first back side and the entire vertical back leg length of a first outer side, further comprising a second back leg member and a securing fixture selectively securing the second back leg member to the first leg portion forming a back leg assembly, the second back leg member having at least a back side, an outer side, a first end and an opposing second end and an entire vertical back leg length defined therebetween, and a second elongated cavity and a portion of an outer side that is positioned facing outward from the side edge of the work surface, a second elongated vertical opening into the second elongated cavity along at least a portion of the entire vertical back leg length of outer side of the second back leg member and at least a portion of the entire vertical back leg length of the front side of the second back leg member, the second elongated cavity of the second back leg member combining with the elongated cavity of the first leg member to define a widened elongated back leg cavity with the selective securing fixture positioning the first elongated vertical opening into the first elongated cavity with the second elongated vertical opening into the second elongated cavity and having a widened elongated vertical side opening defined by their side by side first and second leg members and a combination of the first elongated vertical opening of the first back leg member and the second elongated vertical opening of the second back leg member, wherein the vertical support member of the upper framework is mounted on the back leg assembly and attached thereto for supporting and securement of the upper framework above the back edge of the work surface.

3. The furniture system of claim 2 wherein each upper portion of at least one of the first or second back leg members of the back leg assembly on either side of the work surface includes a top cavity, and wherein each of the two vertical support members of the upper frame includes at least one extending mounting member configured to be received into the top cavity of at least one of the back leg members and wherein at least one of the upper vertical support members and one of the first or second back leg members of the back leg assembly includes the securing fixture for mounting the extending mounting member of the vertical support member thereto.

4. The furniture system of claim 2 wherein the work surface is a first work surface, and wherein each second back leg member is a back leg member supporting a second work surface oriented 180 degrees back to back with the first work surface and having a back edge of the second work surface adjacent to the back edge of the first work surface.

5. The furniture system of claim 4 wherein the back leg members of each of the first and second work surfaces are selectively coupled together to form a unified back to back work surface with the upper framework positioned above the back edge of the first work surface and the back edge of the second work surface.

6. The furniture system of claim 4, further comprising a cavity cover dimensioned for selectively covering the vertical elongated cavity of the upper framework and the combination of the first elongated vertical opening of the first back leg member and the second elongated vertical opening of the second back leg member.

7. The furniture system of claim 1, further comprising an elongated cover dimensioned for selectively covering the elongated vertical opening of both the vertical support member of the upper framework and the elongated vertical opening on the back side and the outer side of the back leg member on which the vertical support is mounted.

8. The furniture system of claim 1 wherein each of the pair of back leg members on each opposing side of the work surface is a first back leg member, further comprising a pair of second back leg members each of which is coupled to a back portion of one of the first back leg members and forming a back leg assembly with the second back leg member, the second back leg member extending backward and outward from the back edge of the work surface, wherein an upper portion of each of the first and second back leg members includes a mounting mechanism for mounting the lower end of one of the vertical support members.

9. The furniture system of claim 1 wherein the front legs include an upper section and a lower section selectively coupled to the upper section, the upper section having a proximate end coupled to the subassembly and the lower end coupling to the lower section, the lower section having a distal end engaging a floor surface on which the furniture system is placed.

10. The furniture system of claim 9 wherein at least one of the upper section and lower section includes a height adjustment fixture for selectively defining a plurality of front leg heights by the selective combination of the upper section and the lower section, and wherein, each back leg member including two or more one leg mounting fixtures proximate to the top end thereof for mounting to the subassembly for selectively mounting at two or more heights the lower leg members thereto.

11. The furniture system of claim 10, further comprising at least one fastener coupling the leg to the subassembly using at least one leg mounting fixture and at least one back leg member attachment mounting fixture, and wherein the back leg member includes a plurality of leg mounting fixtures positioned spaced apart at various distances along the elongated length of the upper portion of the leg and wherein the leg attachment mounting fixture and leg mounting fixture are configured for selective attachment for fixing the leg to the subassembly at one of a plurality of different positions for varying the height of the back leg member from the work surface to the mounting surface.

12. The furniture system of claim 1 wherein the work surface and the subassembly defines a back leg member mounting receptacle for receiving a back leg member, the subassembly including at least one leg attachment mounting fixture positioned for selective alignment with one or more of the leg mounting fixtures.

13. The furniture system of claim 1 wherein the back leg member is rectangular with rounded corners and further has a front substantially flat surface facing towards the front edge of the work surface, an inner substantially flat side surface facing inward toward the opposing side of the work surface, and the back side having the elongated vertical opening into the elongated cavity facing in the same direction of the back edge of the work surface.

14. The furniture system of claim 13 wherein the radii of a corner between the front surface and the outer side surface and the inner side surface is larger than the radii of the corner between the inner side surface and the back side.

15. The furniture system of claim 1 wherein the mounting mechanism of each back leg member includes a top cavity and wherein the lower end of each vertical support member includes an extended portion configured to mate with the cavity of the back leg member on which the vertical support member is mounted.

16. The furniture system of claim 1 wherein the work surface, subassembly, the pair of front legs and the two back leg members are each a first work surface, a first subassembly and a first pair of front legs, and a first pair of back leg members, respectively, further comprising:

a second work surface, a second subassembly, a second pair of front legs and a second pair of two back leg members, the second work surface being oriented 180 degrees from the first work surface with the back edges of each work surface being positioned adjacent to each other, wherein each of the pair of first and second back leg members has at least a portion of a leg-to-leg attachment fixture and wherein each back leg member is configured for parallel alignment and coupling of one of the pair of first back leg members of the first work surface to one of the pair of second back leg members of the second work surface for securement thereto.

17. The furniture system of claim 16 wherein each back leg member of the first pair of leg members and the second pair of leg members includes a portion of an outer side that is positioned facing away from the side edge of the work surface, and wherein the elongated vertical openings of each of the pair of first back leg members and each of the pair of second back leg members corresponding to a different one of each of the pair of the first back leg members are positioned proximate to each other forming a combined side by side elongated vertical outer side opening and a combined elongated cavity therebetween through the coupling of the two back leg members together.

18. The furniture system of claim 17, further comprising a cover dimensioned for selectively covering the combined side by side elongated vertical outer side opening of the combined first and second back leg members forming the back leg assembly and the elongated opening of the vertical support member mounted thereto.

19. The furniture system of claim 17 wherein each pair of coupled back leg members includes an upper portion having a mounting mechanism for mounting a portion of a lower end of one of the vertical support members of the upper frame.

20. The furniture system of claim 17 wherein each upper portion of each coupled leg members includes a top cavity, and wherein each of the two vertical support members of the upper frame includes at least one extending mounting member configured to be received into the top cavity of the back leg member and wherein at least one of the upper vertical support member and one of the first or second back leg members includes a securing fixture for mounting and securing the vertical member of the upper framework to the back leg member.

21. The furniture system of claim 17 wherein each upper portion of each coupled leg members includes a circular shaped top cavity and wherein each of the two vertical support members of the upper frame includes a pair of spaced apart extending tube members configured to be received into the circular cavities of each of the back leg members and wherein the first or second back leg members each includes a securing fixture for securing the extending tube members of the vertical member of the upper framework to the cavities of the back leg members after receiving of the extending tube members therein.

22. A modular laboratory furniture system comprising:

a leg support assembly having a pair of opposing leg members having a first end and an opposing second end and an entire vertical back leg length defined therebetween with an elongated cavity along a length extending downward from a top end thereof and a portion of the entire vertical back leg length of an outer side that is positioned facing outward and at least a portion of the entire vertical back leg length of a back side defining an elongated vertical opening into the elongated cavity of each leg member, the leg support assembly having a lateral member positioned between the two opposing leg members and having a surface mounting member positioned at a bottom end; and a selectively attachable upper framework positionable above the lateral member and having two opposing vertical support members supporting at least one horizontal member that extends between the two vertical support members, each vertical support member having a top end, a lower end, a vertical elongated cavity along its length, and an outward facing vertical elongated opening to the cavity, the cavity configured for receiving one or more utility distribution fixtures and a mounting mechanism for mounting the lower end of the vertical support members of the upper framework to the top portion of the back leg members.

23. The furniture system of claim 22 wherein each leg member includes a top cavity and each vertical member includes an extending member configured to be inserted into the top cavity and further including a securing feature for securing the extending member into the inserted top cavity of each leg member.

24. A method of assembling a modular laboratory furniture system comprising:

attaching a work surface having a front edge, a back edge, two opposing side edges, a top surface and a bottom surface to a subassembly position below the work surface and on which the work surface is mounted and supported;

attaching a pair of front legs to the subassembly;

selectively coupling a pair of back leg members to the subassembly proximate to a back corner of the subassembly proximate to the intersection of one of the side lateral supports and an end of the back lateral support, each back leg member having a back side, an outer side, a first end and an opposing second end and an entire vertical back leg length defined therebetween, and an elongated cavity and an elongated opening to the elongated cavity along the entire vertical back leg length of at least a portion of a back side of each back leg member and at least a portion of the entire vertical back leg length of an outer side of each back leg member that is positioned facing outward from the side edge of the work surface;

selectively attaching an upper framework above the back edge of the work surface, the upper framework having two opposing vertical support members supporting at least one horizontal member that extends between the two vertical support members, each vertical support member having a top end, a lower end that is selectively coupled to a top portion of one of the back leg members, the upper framework also having a vertical elongated cavity along its length and a cross-section that is about twice the size of a cross section of each back leg member, and an outward facing vertical elongated opening to the cavity, the cavity configured for receiving one or more utility distribution fixtures; and securing each vertical support member to one of the back leg members.

25. The method of claim 24 wherein attaching the vertical support members of the upper framework includes inserting an extending member of the lower end of the vertical support member into a top cavity defined in the top portion of the back leg members.

26. The method of claim 25, further comprising securing the extending member that is inserted into the top cavity of the top portion of the back leg members for fixedly attaching the upper framework to the back leg members.

27. The method of claim 24, further comprising selectively placing a single elongated cover over the vertical elongated opening of the vertical support member and the elongated opening of the on the back side and the outer side back leg member on which the vertical support member is mounted.

28. The method of claim 24 wherein the pair of back leg members is a first pair of back leg members, further comprising:

selectively attaching each of a pair of second back leg members to the first back leg members on a backward facing side thereof with the attached second back leg member extending backward and beyond the back edge of the work surface, each second leg member having an elongated cavity and a second elongated vertical opening thereto defined by a second elongated opening on the outer side of the second back leg members and as elongated opening on a front side of the second back leg members, and wherein selectively attaching the upper framework includes selectively coupling a lower end of each vertical support member to each of the attached first and second back leg members so that the upper framework is selectively mounted to the attached first and second back leg members, and the elongated opening on the back side of the first leg members is adjacent to the elongated opening on the front side of the back leg members enclosing each other, and forming a widened side by side elongated opening on the outer sides of the first leg member and the second leg member attached thereto.

29. The method of claim 28 wherein attaching the vertical support members of the upper framework includes inserting a pair of extending members of the lower end of each vertical support member into a pair of top cavities defined in the top portions of each of the first and second back leg members.

30. The method of claim 29, further comprising securing the extending members inserted within the top cavities of the top portions of the back leg members for fixedly attaching the upper framework to the coupled pair of back leg members forming a back leg assembly.

31. The method of claim 28, further comprising selectively placing a single elongated cover over the vertical elongated cavity of the vertical support member and the combined side by side openings of each of the coupled back leg members on which the vertical support member is mounted.

32. The method of claim 24 wherein the work surface, the subassembly, and the pair of front legs are each a first work surface, a first subassembly, a first pair of front legs, further comprising:

attaching a second work surface having a front edge, a back edge, two opposing side edges, a top surface and a bottom surface to a second subassembly position below the second work surface and on which the second work surface is mounted and supported;

attaching a pair of second front legs to the second subassembly;

positioning the coupled second work surface attached to the second subassembly in a back to back position relative to the first work surface so that each back edge is adjacent and abutted against each other and forming a combined work surface;

selectively attaching the second back leg members that are selectively attached to the first back leg members to a second subassembly to the second subassembly;

wherein selectively attaching the upper framework includes selectively coupling a lower end of each vertical support member to each of the attached first and second back leg members so that the upper framework is selectively mounted to the attached first and second back leg members.

33. The method of claim 32 wherein selectively attaching the upper framework includes inserting a pair of extending members of the lower end of each vertical support member into a pair of top cavities defined in the top portions of each of the first and second back leg members.

34. The method of claim 33, further comprising securing the inserted extending members inserted into the top cavities of the top portions of the back leg members for fixedly attaching the upper vertical members to the coupled pair of back leg members on each side of the back side of the combined work surface.

35. The method of claim 32, further comprising selectively placing a single elongated cover over the vertical elongated cavity of the vertical support member and the combined side by side outer side opening formed by the side by side positioning of the elongated outer side openings of the combined and coupled first and second back leg members on which the vertical support member is mounted.

* * * * *